US010626651B2

(12) United States Patent
Chang

(10) Patent No.: US 10,626,651 B2
(45) Date of Patent: Apr. 21, 2020

(54) HINGE FOR OPENING/CLOSING DOOR

(71) Applicant: Jong Bok Chang, Siheung-si (KR)

(72) Inventor: Jong Bok Chang, Siheung-si (KR)

( * ) Notice: Subject to any disclaimer, the term of this patent is extended or adjusted under 35 U.S.C. 154(b) by 0 days.

(21) Appl. No.: 15/781,273

(22) PCT Filed: Dec. 9, 2016

(86) PCT No.: PCT/KR2016/014430
§ 371 (c)(1),
(2) Date: Jun. 4, 2018

(87) PCT Pub. No.: WO2017/099511
PCT Pub. Date: Jun. 15, 2017

(65) Prior Publication Data

US 2018/0363347 A1 Dec. 20, 2018

(30) Foreign Application Priority Data

Dec. 10, 2015 (KR) ..... 10-2015-0175742
Jun. 3, 2016 (KR) ..... 10-2016-0069463

(51) Int. Cl.
*E05F 1/12* (2006.01)
*E05D 5/12* (2006.01)
(Continued)

(52) U.S. Cl.
CPC ..... *E05F 1/1223* (2013.01); *E05D 5/12* (2013.01); *E05F 1/1215* (2013.01); *E05F 3/20* (2013.01); *E05D 3/02* (2013.01); *E05Y 2900/132* (2013.01)

(58) Field of Classification Search
CPC ..... E05D 5/12; E05D 5/121; E05D 2005/122; E05D 2005/124; E05F 1/1223;
(Continued)

(56) References Cited

U.S. PATENT DOCUMENTS 1,883,506 A * 10/1932 Bommer ..... E05F 1/1215 16/301
4,043,001 A * 8/1977 Parsons ..... E05F 1/1215 16/222
(Continued)

FOREIGN PATENT DOCUMENTS

JP 2002-030856 A 1/2002
KR 10-2001-0036541 A 5/2001
(Continued)

*Primary Examiner* — Jeffrey O'Brien
(74) *Attorney, Agent, or Firm* — Rabin & Berdo, P.C.

(57) ABSTRACT

The present invention provides a hinge for opening/closing a door, comprising: left and right plates respectively coupled to the door and a door frame; a main housing formed in the center of any one of the left and right plates; upper and lower auxiliary housings respectively formed at the top and the bottom of the other of the left and right plates; a support member coupled to and linked with the main housing by penetrating into any one of the upper and lower auxiliary housings; a guide member coupled to and linked with the other of the upper and lower auxiliary housings, formed by inserting a portion thereof into the main housing, and having a screw hole for adjustment; an adjustment member having a screw bar for adjustment and a screw bar for fixing, which are formed to have different screwing directions as a right-handed screw and a left-handed screw, and having an adjustment space for interference prevention between the screw bar for adjustment and the screw bar for fixing; a fixing member for fixing the adjustment member by closely attaching, to the guide member through the adjustment space, the screw bar for fixing the adjustment member; and a twist spring connectedly provided between the support member and the adjustment member so as to change the strength of elasticity by the rotation of the adjustment member.

2 Claims, 7 Drawing Sheets

(51) Int. Cl.
*E05F 3/20* (2006.01)
*E05D 3/02* (2006.01)

(58) Field of Classification Search
CPC ..... E05F 1/1215; E05F 1/1207; E05F 1/12; E05F 3/20
See application file for complete search history.

(56) References Cited

U.S. PATENT DOCUMENTS 4,073,038 A * 2/1978 Curry ..... E05F 1/1215 16/301
4,102,013 A * 7/1978 Newlon ..... E05D 5/128 16/222
4,141,123 A * 2/1979 Newlon ..... E05D 5/128 29/11
4,583,262 A * 4/1986 Werner ..... E05F 1/1215 16/300
5,048,155 A * 9/1991 Hwang ..... E05F 1/1215 16/301
5,584,100 A * 12/1996 Doyle ..... E05F 1/1215 16/299
5,651,536 A * 7/1997 Daul ..... E05F 1/1215 267/205
5,715,574 A * 2/1998 Schall ..... E05F 1/1215 16/301
6,460,220 B1 * 10/2002 Jackson ..... E05F 1/1215 16/285
6,618,902 B2 * 9/2003 Wu ..... E05F 1/1215 16/298
6,732,408 B2 * 5/2004 Wu ..... E05D 11/00 16/273
7,111,358 B1 * 9/2006 Jackson ..... E05F 1/1215 16/50
7,111,363 B2 * 9/2006 Lee ..... E05D 11/1078 16/295
8,549,707 B2 * 10/2013 Macernis ..... E05F 1/1215 16/298
8,955,194 B2 * 2/2015 Teta ..... E05F 1/1207 16/222
2007/0000090 A1 * 1/2007 Wu ..... E05D 11/0054 16/299
2007/0039131 A1 * 2/2007 Rude ..... E05F 1/1215 16/277
2016/0083993 A1 * 3/2016 Grewe ..... E05F 1/1223 16/291
2018/0223574 A1 * 8/2018 Babikian ..... E05D 3/02
2018/0283067 A1 * 10/2018 Wu ..... E05D 7/0027
2018/0291663 A1 * 10/2018 Wu ..... E05F 1/066

FOREIGN PATENT DOCUMENTS

KR 20-0328910 Y1 10/2003
KR 10-2010-0021337 A 2/2010
KR 10-2013-0131036 A 12/2013

* cited by examiner

HINGE FOR OPENING/CLOSING DOOR

TECHNICAL FIELD

The present invention relates to a hinge for opening/closing a door, and more particularly, to a hinge for opening/closing a door that is capable of adjusting a degree of elasticity in simple, convenient and precise manners to stably maintain the degree of elasticity set.

BACKGROUND ART

Generally, hinges for doors are classified into hinges operating manually and free hinges for automatically closing the doors open through a spring, hydraulic pressure, or a combination of the two.

According to the conventional hinges, the door becomes closed by means of elasticity of the spring after has been open, and at this time, the elasticity of the spring is constantly maintained through the hydraulic pressure, so that the door can be slowly closed.

According to the conventional spring hinges, further, if the door is open, the spring built in the hinge is compressed, and if it is desired that the door is closed, the compressed spring at the time when the door has been open is restored to its original position, so that the door becomes closed.

According to the conventional hinges, however, the degree of elasticity of the spring is generally adjusted in the unit of a click interval of a clutch, thereby making it impossible to precisely adjust the degree of elasticity of the spring.

Particularly, a diameter of a rotary shaft of the conventional hinge is limitedly designed so that it is almost impossible to set tight click intervals.

Moreover, the spring used for the hinge is a twist spring, and accordingly, the degree of elasticity of the twist spring is not adjusted in such a manner as to be wound or unwound by the number of turns thereof, but adjusted to a given angle range due to the changes in diameters and the limitation in the diameter of the rotary shaft, so that it is almost impossible to precisely adjust the degree of elasticity of the twist spring to the unit of click.

So as to solve the above-mentioned problems, accordingly, a hinge for opening/closing a door has been proposed in Korean Patent Application Laid-open No. 10-2013-0131036 (Dated Dec. 3, 2013) filed by the same applicant as the invention. According to the conventional hinge for opening/closing a door, the degree of elasticity of the twist spring is finely adjusted, but due to the opening/closing of the door, the finely adjusted state of the twist spring is released so that the degree of elasticity of the twist spring has to be frequently adjusted again.

DISCLOSURE

Technical Problem

Accordingly, the present invention has been made in view of the above-mentioned problems occurring in the prior art, and it is an object of the present invention to provide a hinge for opening/closing a door that is capable of finely adjusting a degree of elasticity of a twist spring to accurately set an opening/closing force of the door, so that even if the hinge is used for a long period of time, it works gently, performs the adjustment and setting operations in a simple and convenient manner, and maintains the set degree of elasticity in a continuous and stable manner.

It is another object of the present invention to provide a hinge for opening/closing a door that is capable of allowing a twist spring to have a degree of elasticity in a given range within a door opening/closing section thereof, so that the door can be gently open and closed only with the twist spring, thereby achieving mass production at a low cost and a high quality.

Technical Solution

To accomplish the above-mentioned objects, according to the present invention, there is provided a hinge for opening/closing a door, the hinge including: a support member adapted to pass through any one of upper and lower auxiliary housings in such a manner as to be coupledly interlocked with a main housing; a guide member coupledly interlocked with the other of the upper and lower auxiliary housings and having an adjusting screw hole; an adjustment member having an adjusting screw bar coupled to the adjusting screw hole of the guide member, a fixing screw bar protruding upwardly from the adjusting screw bar, screws of the adjusting screw bar and the fixing screw bar being spiral differently from each other in left-handed and right-handed directions to firmly maintain a set state, and an adjustment space formed between the adjusting screw bar and the fixing screw bar to prevent occurrence of interference; a fixing member coming into close contact with the guide member through the adjustment space to fix the adjustment member thereto; and a twist spring disposed between the support member and the adjustment member in such a manner as to be connected to the support member and the adjustment member and to be adjusted in a degree of elasticity through rotation of the adjustment member.

Advantageous Effects

According to the present invention, the adjusting screw bar is coupled to the adjusting screw hole of the guide member to allow the twist spring to be adjusted in the degree of elasticity through the screw rotation, so that the twist spring is finely adjusted to the user's desired degree of elasticity; further, the screws of the adjusting screw bar and the fixing screw bar of the adjustment member are spiral differently from each other in the left-handed and right-handed directions, so that the adjusting screw bar and the fixing screw bar of the adjustment member operate reversely to each other to allow the finely adjusted state of the twist spring to be rigidly and stably maintained; and also, the adjustment space is formed between the adjusting screw bar and the fixing screw bar to prevent the occurrence of interference in the adjusting and fixing operations according to the different directions of the screws.

MODE FOR INVENTION

Figure 1:
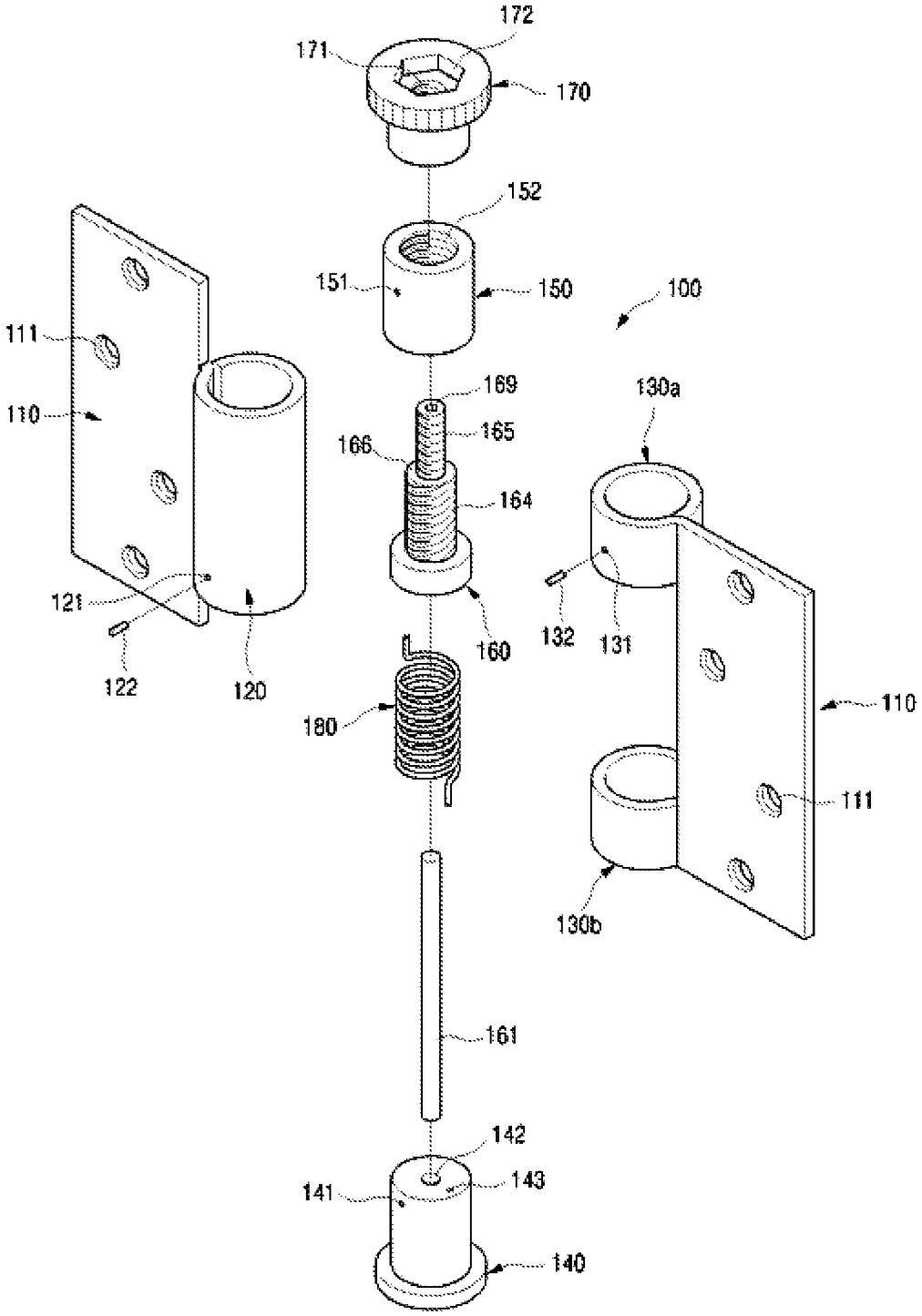
FIG. 1 is an exploded perspective view showing a hinge for opening/closing a door according to one embodiment of the present invention.
Figure 2:
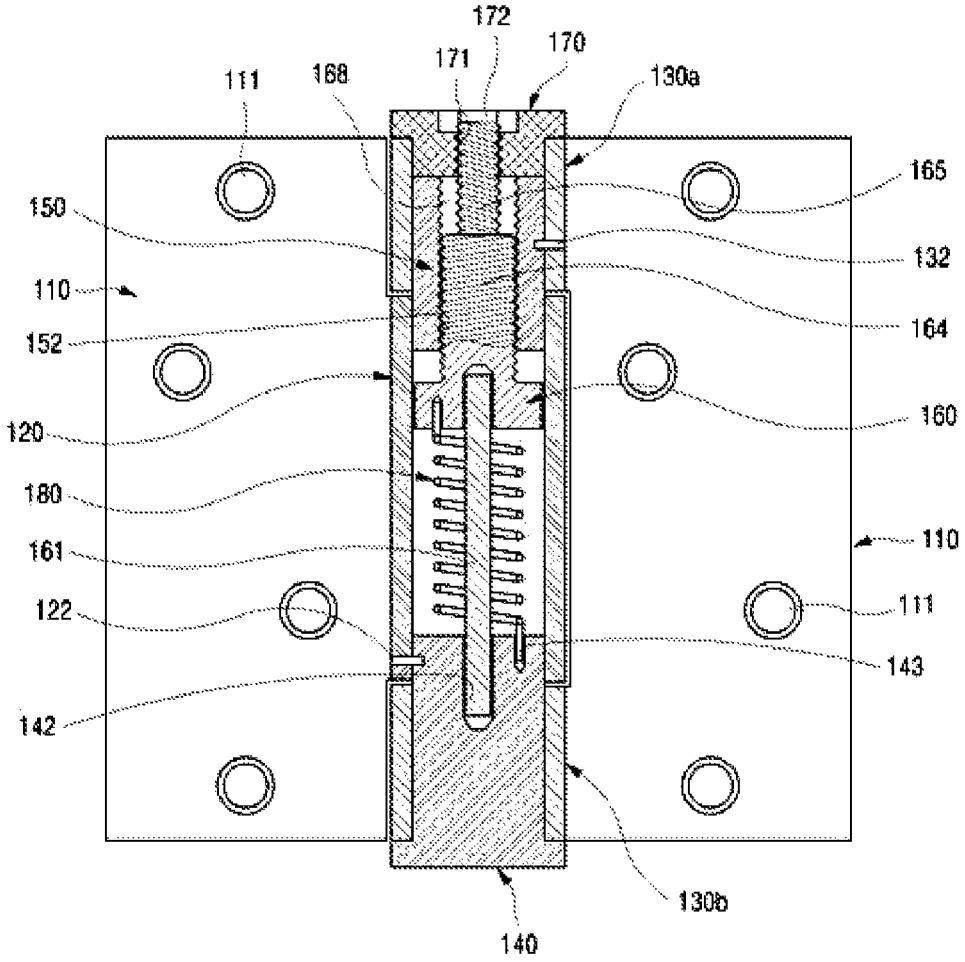
FIG. 2 is a sectional view showing the hinge for opening/closing a door according to one embodiment of the present invention.
Figure 3:
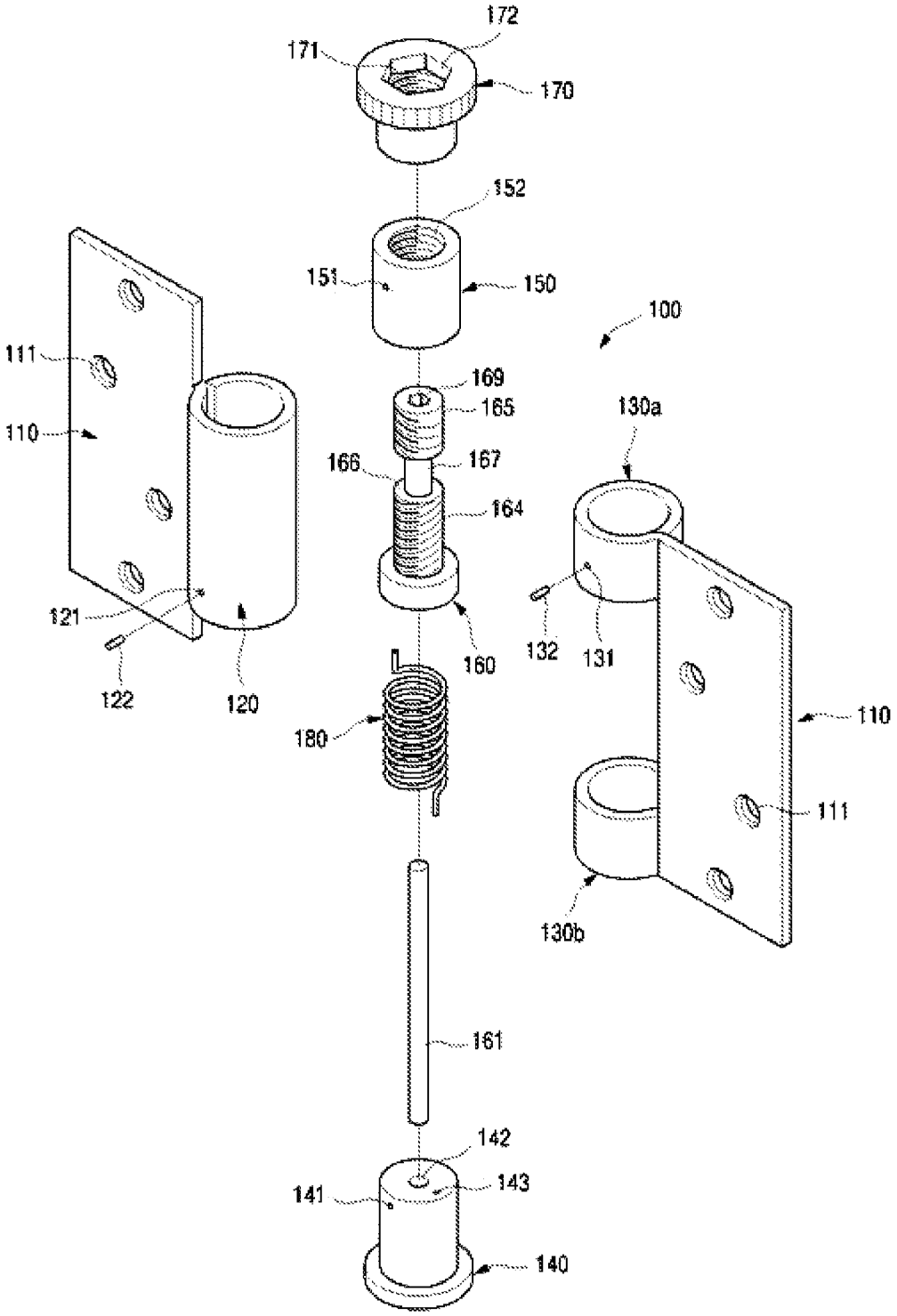
FIG. 3 is an exploded perspective view showing a hinge for opening/closing a door according to another embodiment of the present invention.
Figure 4:
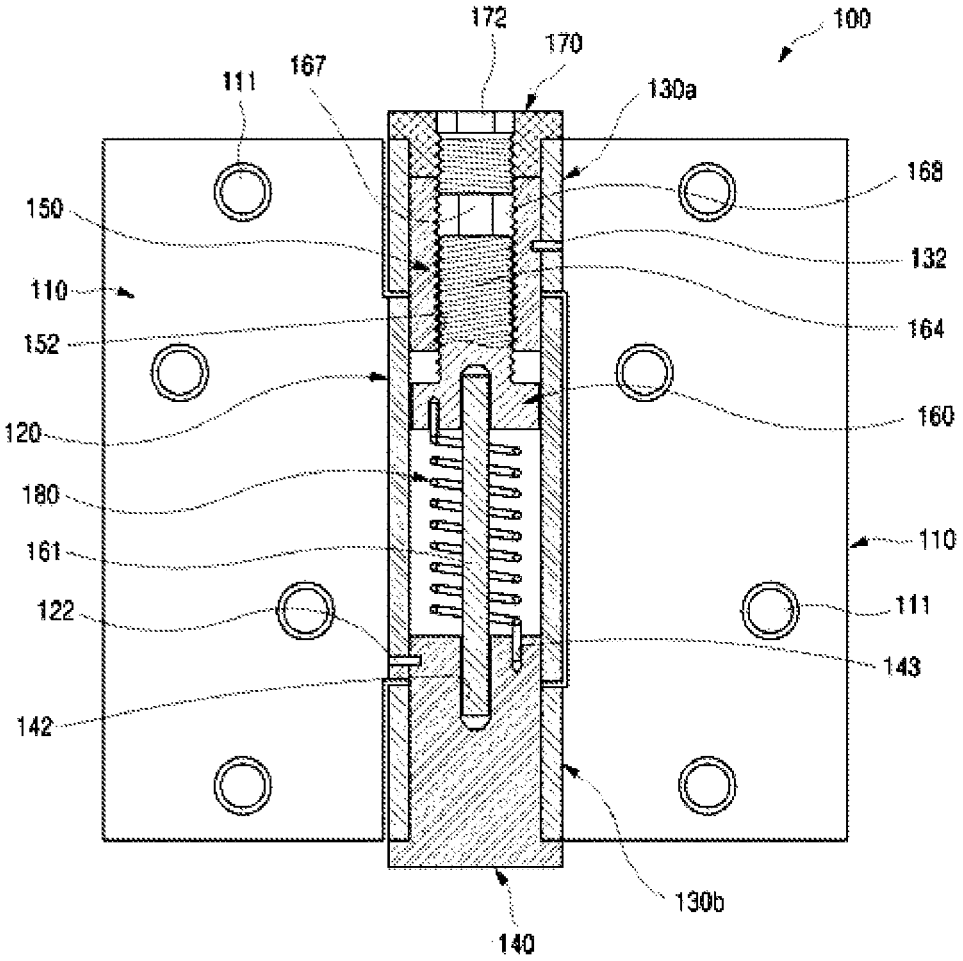
FIG. 4 is a sectional view showing the hinge for opening/closing a door according to another embodiment of the present invention.

Hereinafter, an explanation on a hinge for opening/closing a door according to the present invention will be in detail given with reference to the attached drawing.

As shown in FIGS. 1 to 4, a hinge 100 for opening/closing a door according to one embodiment of the present invention includes: left and right plates 110 coupled correspondingly to the door and a door frame; a main housing 120 disposed on a center of any one of the left and right plates 110; upper and lower auxiliary housings 130*a* and 130*b* disposed correspondingly to the upper and lower ends of the other of the left and right plates 110; a support member 140 adapted to pass through any one of the upper and lower auxiliary housings 130*a* and 130*b* in such a manner as to be coupledly interlocked with the main housing 120; a guide member 150 coupledly interlocked with the other of the upper and lower auxiliary housings 130*a* and 130*b* and having an adjusting screw hole 152; an adjustment member 160 having an adjusting screw bar 164 coupled to the adjusting screw hole 152 of the guide member 150, a fixing screw bar 165 protruding upwardly from the adjusting screw bar 164, screws of the adjusting screw bar 164 and the fixing screw bar 165 being spiral differently from each other in left-handed and right-handed directions, and an interference prevention adjustment space 168 formed between the adjusting screw bar 164 and the fixing screw bar 165; a fixing member 170 coming into close contact with the guide member 150 through the adjustment space 168 to fix the adjustment member 160 thereto; and a twist spring 180 disposed between the support member 140 and the adjustment member 160 in such a manner as to be connected to the support member 140 and the adjustment member 160 and to be adjusted in a degree of elasticity through rotation of the adjustment member 160.

The left and right plates 110 are coupled correspondingly to the door and the door frame, and generally, they have a plurality of coupling holes 111 formed piercedly thereon.

The main housing 120 is cylindrically shaped in such manner as to be disposed on the center of any one of the left and right plates 110 and has a pin hole 121 formed piercedly on a lower periphery thereof in such a manner as to insert a setting pin 122 thereinto.

The upper and lower auxiliary housings 130*a* and 130*b* are cylindrically shaped in such a manner as to be disposed correspondingly to the upper and lower ends of the other of the left and right plates 110, and the upper auxiliary housing 130*a* has a pin hole 131 formed piercedly on a lower periphery thereof in such a manner as to insert a setting pin 132 thereinto.

In this case, the main housing 120 is disposed between the upper and lower auxiliary housings 130*a* and 130*b* and has the same diameter as each of the upper and lower auxiliary housings 130*a* and 130*b*.

The support member 140 passes through the lower auxiliary housing 130*b* in such a manner as to be fixedly interlocked with the main housing 120 and has a pin hole 141 formed on the outer peripheral surface thereof in such a manner as to correspond to the pin hole 121 of the main housing 120. Accordingly, the pin hole 141 and the pin hole 121 are fixed to each other by means of the setting pin 122 to allow the support member 140 and the main housing 120 to be interlocked with each other.

In this case, the support member 140 has a shaft hole 142 and a fixing hole 143 formed on a top surface thereof, and at this time, the shaft hole 142 is formed at a center of the top surface of the support member 140.

The guide member 150 passes through the upper auxiliary housing 130*a* in such a manner as to allow a portion thereof to be inserted into the main housing 120 and thus to be fixedly interlocked with the upper auxiliary housing 130*a* and has a pin hole 151 formed on the outer peripheral surface thereof in such a manner as to correspond to the pin hole 131 of the upper auxiliary housing 130*a*. Accordingly, the pin hole 151 and the pin hole 131 are fixed to each other by means of the setting pin 132 to allow the guide member 150 and the upper auxiliary housing 130*a* to be interlocked with each other.

In this case, desirably, the guide member 150 is cylindrically shaped and has the adjusting screw hole 152 vertically passing therethrough.

However, the adjusting screw hole 152 may become a screw formed directly on the inner peripheral surface of the upper auxiliary housing 130*a*, and as mentioned above, it may be formed on the guide member 150.

The adjustment member 160 has the adjusting screw bar 164 coupled to the adjusting screw hole 152 of the guide member 150 to perform precise adjustment, and at the same time, the adjustment member 160 is interlocked with the guide member 150 through screw coupling. Further, the adjustment member 160 has the fixing screw bar 165 protruding upwardly from the adjusting screw bar 164.

Especially, the screws of the adjusting screw bar 164 and the fixing screw bar 165 of the adjustment member 160 are spiral differently from each other in the left-handed and right-handed directions, and the adjustment member 160 further has the adjustment space 168 formed between the adjusting screw bar 164 and the fixing screw bar 165 to prevent the occurrence of interference in the adjusting and fixing operations according to the different directions of the screws and at the same time to firmly maintain the set state.

In this case, the adjustment member 160 has a shaft hole 162 and a fixing hole 163 formed on an underside surface thereof, and at this time, the shaft hole 162 is formed at the center of the underside surface of the adjustment member 160. Further, desirably, the adjustment member 160 has a shaft 161 connected to the shaft hole 142 of the support member 140.

Furthermore, a connector 167 is disposed between the adjusting screw bar 164 and the fixing screw bar 165 of the adjustment member 160, which serves as the adjustment space 168.

Moreover, the adjustment member 160 has a key groove 169 formed on a top of the fixing screw bar 165 so that the adjustment through the adjustment member 160 can be easily performed.

The fixing member 170 has an adjusting and fixing screw hole 171 coupled to the fixing screw bar 165 through the upper auxiliary housing 130*a* and a key groove 172 formed on a center of a top surface thereof or a nut disposed on the outer peripheral surface thereof.

The twist spring 180 is disposed between the adjustment member 160 and the support member 140 in such a manner as to be connected to the adjustment member 160 and the support member 140, and in this case, desirably, both ends of the twist spring 180 are fittedly connected to the fixing holes 163 and 143 of the adjustment member 160 and the support member 140.

On the other hand, the adjustment member 160 coupled to the guide member 150 and the fixing member 170 in the different screw directions may be differently configured by selecting cams disposed in different directions, a spiral groove and a pin coupled to each other, and other means.

Figure 5:
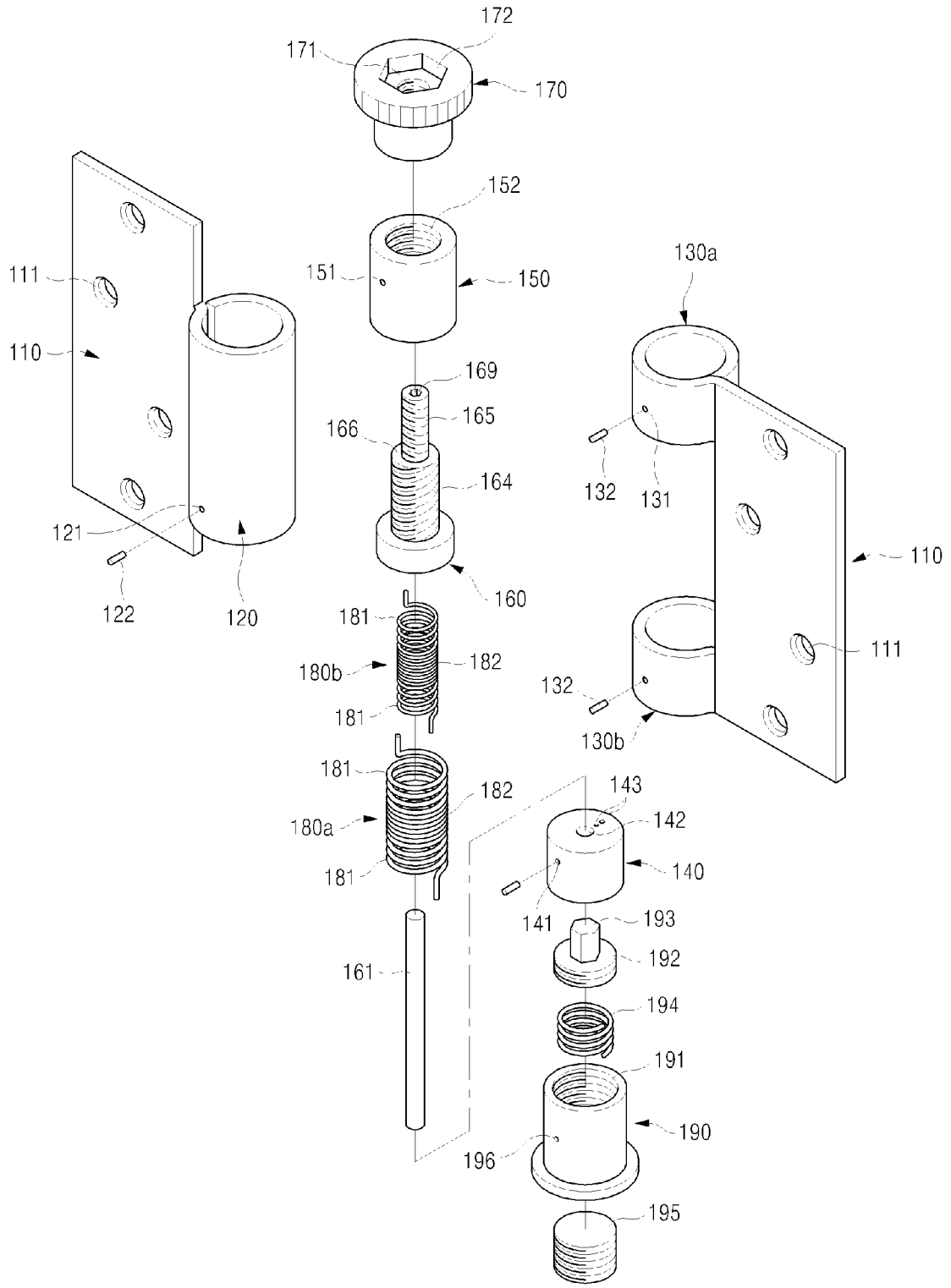
FIG. 5 is an exploded perspective view showing a hinge for opening/closing a door according to yet another embodiment of the present invention.
Figure 6:
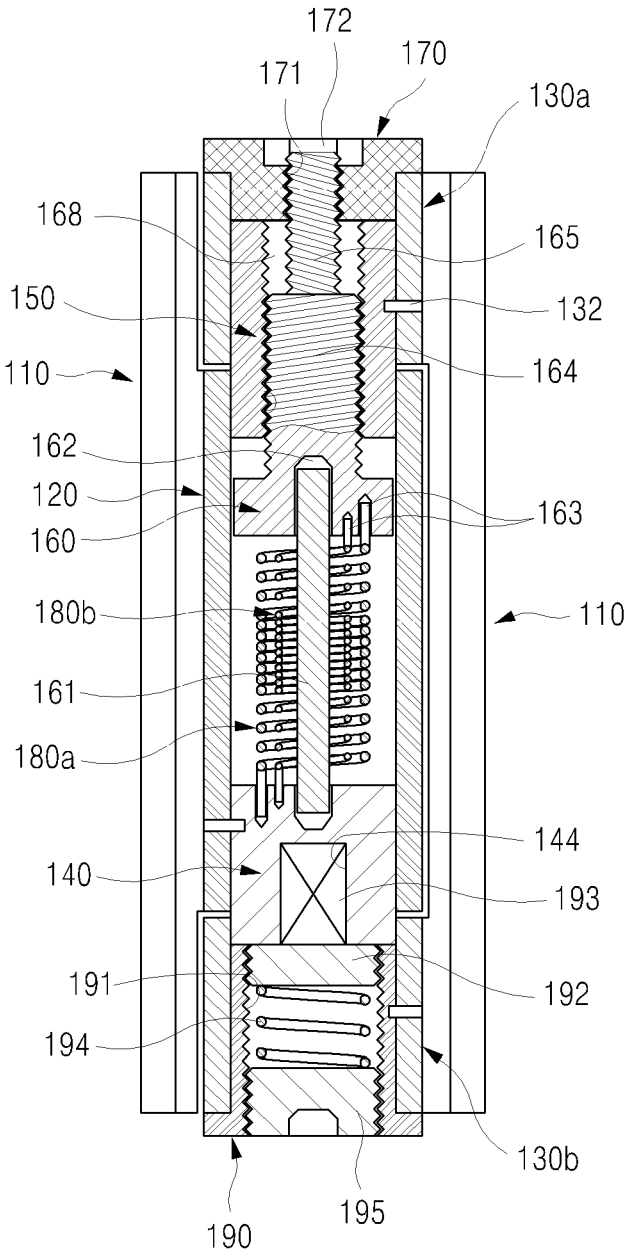
FIG. 6 is a sectional view showing the hinge for opening/closing a door according to yet another embodiment of the present invention at the time when the door is closed.
Figure 7:
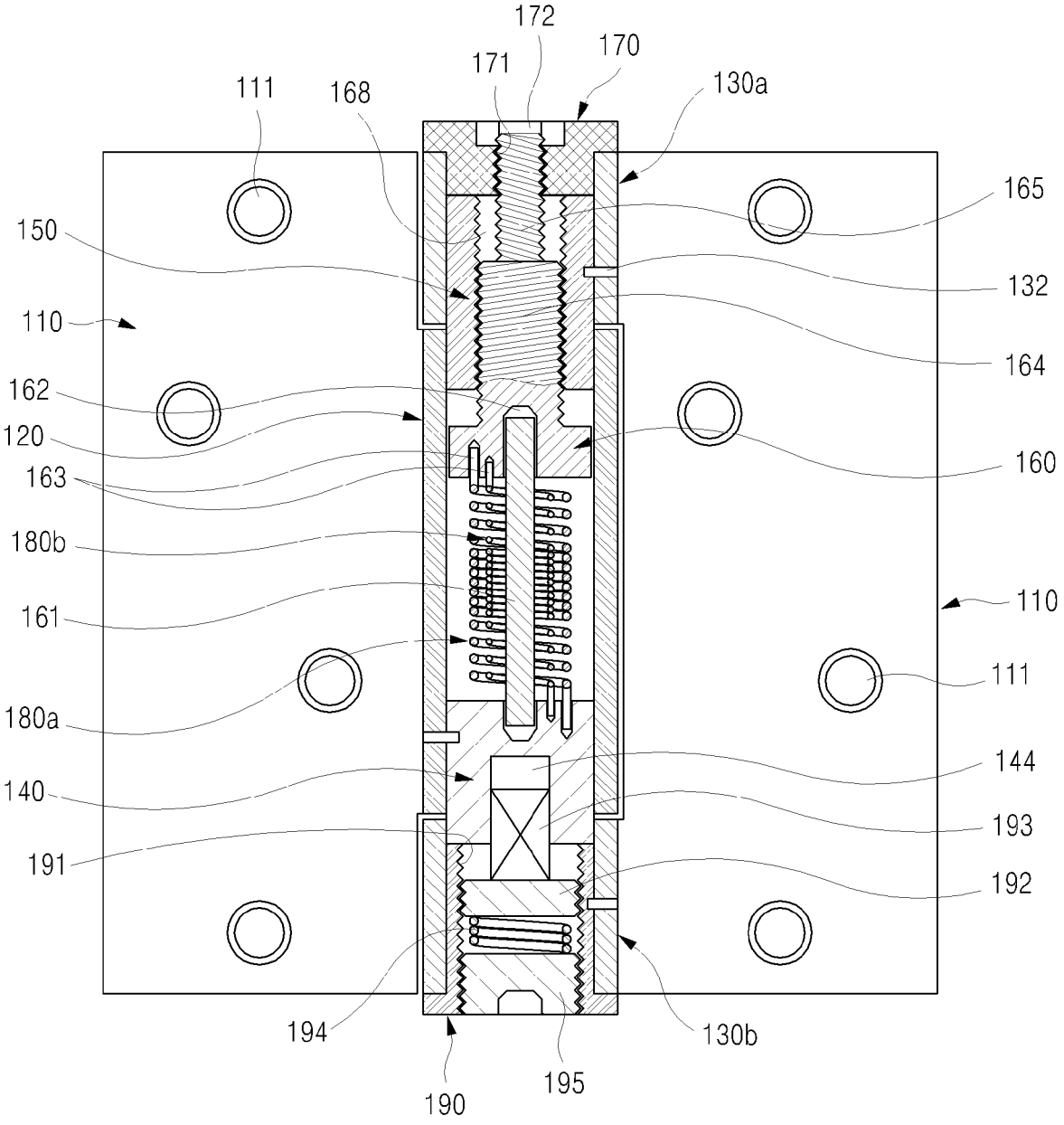
FIG. 7 is a sectional view showing the hinge for opening/closing a door according to yet another embodiment of the present invention at the time when the door is open.

As shown in FIGS. 5 to 7, a hinge 100 for opening/closing a door according to yet another embodiment of the present invention further includes: twist springs 180*a* and 180*b* disposed between the support member 140 and the adjustment member 160 in such a manner as to be connected to the support member 140 and the adjustment member 160 and to be adjusted in a degree of elasticity through the rotation of the adjustment member 160; and an auxiliary elastic guide member 190 disposed on the underside of the support member 140 in such a manner as to be coupled to the lower auxiliary housing 130*b* and adapted to control the elasticity of the twist springs 180*a* and 180*b* in such a manner as to allow the twist springs 180*a* and 180*b* to operate at desired speeds.

The twist springs 180*a* and 180*b* are disposed between the support member 140 and the adjustment member 160 in such a manner as to be connected to the support member 140 and the adjustment member 160, and in this case, desirably, both ends of the twist springs 180*a* and 180*b* are fittedly connected to the fixing holes 163 and 143 of the adjustment member 160 and the support member 140.

Particularly, each of the twist springs 180*a* and 180*b* has first elastic portions 181 formed on the upper and lower portions thereof in such a manner as to allow coil gaps thereon to become large and a second elastic portion 182 formed on an intermediate portion thereof in such a manner as to allow coil gaps thereon to become small, so that initial twist elasticity occurs on the first elastic portions 181 and is gradually applied to the second elastic portion 182. At the same time, the twist springs 180*a* and 180*b* are disposed to obtain elasticity through the coils having small diameters and to thus prevent the degree of elasticity from being drastically changed, so that they operate with the degree of elasticity within a desired range and also provide gentle elasticity.

Furthermore, the twist springs 180*a* and 180*b* are not limited particularly to the positions and numbers of the first elastic portions 181 and the second elastic portion 182, but they are configured to allow the initial twist elasticity to occur on the first elastic portions 181 and thus to be gradually applied to the second elastic portion 182, thereby preventing the degree of elasticity from being drastically changed by the changes in angles and thus to allow only degree of elasticity with the desired range at a given angle to be exerted.

The auxiliary elastic guide member 190 is disposed on the underside of the support member 140 in such a manner as to be coupled to the lower auxiliary housing 130*b* and is adapted to control the elasticity of the twist springs 180*a* and 180*b* in such a manner as to allow the twist springs 180*a* and 180*b* to operate at the desired speeds. The auxiliary elastic guide member 190 has a pin hole 196 formed on the outer peripheral surface thereof in such a manner as to correspond to the pin hole 131 of the lower auxiliary housing 130*b*, and accordingly, the pin hole 196 and the pin hole 131 are fixed to each other by mean of the setting pin 132 to allow the auxiliary elastic guide member 190 and the lower auxiliary housing 130*b* to be interlocked with each other.

Furthermore, the auxiliary elastic guide member 190 has a screw hole 191 formed in a longitudinal direction thereof, an operating bolt 192 coupled to an upper periphery of the screw hole 191, and a key 193 protruding upwardly from a top surface of the operating bolt 192.

Moreover, the auxiliary elastic guide member 190 has an auxiliary elastic member 194 made of a spring, rubber or another elastic material in such a manner as to be insertedly disposed under the operating bolt 192 and an adjusting bolt 195 coupled to the screw hole 191 under the auxiliary elastic member 194 to adjust the degree of elasticity of the auxiliary elastic member 194.

Further, the auxiliary elastic member 194 is made of dish-shaped plate springs sequentially laminated on each other in such a manner as to be symmetrical up and down to each other, but of course, it may be made of elastic materials machined to various shapes.

In this case, when the key 193 of the operating bolt 192 is fittedly and rotatingly interlocked with a key groove 144 formed upwardly from the underside of the support member 140, desirably, the operating bolt 192 is ascended and descended according to rotating directions thereof.

Now, an explanation on the operation of the hinge 100 for opening/closing a door according to the present invention will be given.

In the state where the hinge 100 is installed, first, if the fixing member 170 is unfastened, it is released from the contacted state with the guide member 150 and is thus separated appropriately from the guide member 150. At this time, the adjustment member 160 rotates or reversely rotates to wind or unwind the twist spring 180, 180*a* and 180*b*, so that the degree of elasticity of the twist spring 180 is adjusted. After the adjustment, the fixing member 170 is fastened again and is then brought into close contact with the upper end periphery of the guide member 150, so that the degree of elasticity of the twist spring 180, 180*a* and 180*b* can be easily adjusted and fixed.

In detail, the bottom ends of the twist springs 180, 180*a* and 180*b* are fixed to the support member 140 and the top ends thereof are fixed to the adjustment member 160, so that the twist springs 180, 180*a* and 180*b* are wound or unwound according the rotation or reverse rotation of the adjustment member 160, thereby being adjusted in their elasticity.

Accordingly, the support member 140 is coupledly interlocked with the main housing 120, and the adjustment member 160 is coupled to the guide member 150. At the same time, the guide member 150 is coupledly interlocked with the upper auxiliary housing 130*a*, and accordingly, the degree of elasticity of the hinge 100 is adjusted.

Concurrently, if the support member 140 coupled to the main housing 120 interlockedly rotates, the operating bolt 192 fitted to the key groove 144 rotates, and accordingly, the operating bolt 192 coupled to the screw hole 191 is descended to slowly pressurizedly compress the auxiliary elastic member 194 thereagainst.

On the other hand, the door becomes closed by means of the elasticity of the twist springs 180*a* and 180*b* wound, and at this time, the door is gently closed with the degree of elasticity in an appropriate range. Further, the operating bolt 192 reversely rotates and is thus ascended to release the auxiliary elastic member 194 from the compressed state thereof, thereby assisting the restoring forces of the twist springs 180*a* and 180*b* and at the same time inducing the door to be accurately and perfectly closed.

Moreover, the operating bolt 192 coupled to the screw hole 191 reversely rotates after rotated, thereby allowing the door to be closed, and accordingly, the auxiliary elastic member 194 pressurized to a maximum pressure applies a maximum pressurizing force even to the operating bolt 192, so that a strong pressurizing force is generated to prevent the twist springs 180*a* and 180*b* from being suddenly unwound.

At the time when the open door is closed, accordingly, it is not suddenly closed, thereby improving the reliability of a product, suppressing the occurrence of safety accidents, and allowing the degree of elasticity of the auxiliary elastic member 194 to be simply and conveniently adjusted through the adjusting bolt 195.

According to the present invention, further, the adjusting screw bar 164 is coupled to the adjusting screw hole 152 of the guide member 150, and through the screw rotation of the adjusting screw bar 164, the degree of elasticity of the twist springs 180*a* and 180*b* is adjusted, so that the twist springs 180*a* and 180*b* can be finely adjusted to a user's desired degree of elasticity.

Furthermore, the screws of the adjusting screw bar 164 and the fixing screw bar 165 of the adjustment member 160 are spiral differently from each other in the left-handed and right-handed directions, and after the fine adjustment, if the fixing member 170 comes into close contact with the guide member 150, the adjusting screw bar 164 and the fixing screw bar 165 of the adjustment member 160 operate reversely to each other with respect to an external force to prevent the twist springs 180*a* and 180*b* from being unwound. Accordingly, the finely adjusted states of the twist springs 180*a* and 180*b* can be rigidly and stably maintained.

Further, the adjustment space 168 is formed between the adjusting screw bar 164 and the fixing screw bar 165 to prevent the occurrence of interference in the adjusting and fixing operations according to the different directions of the screws and at the same time to maintain the set state rigidly.

According to the present invention, particularly, each of the twist springs 180*a* and 180*b* has the first elastic portions 181 formed on the upper and lower portions thereof in such a manner as to allow coil gaps thereon to become large and the second elastic portion 182 formed on an intermediate portion thereof in such a manner as to allow coil gaps thereon to become small, so that initial twist elasticity occurs on the first elastic portions 181 and is gradually applied to the second elastic portion 182. The twist springs 180*a* and 180*b* have the degree of elasticity in a given range within a door opening and closing section, so that the door can be gently open and closed only with the twist springs 180*a* and 180*b* and also efficiently operate with soft elasticity of the twist springs 180*a* and 180*b*.

According to the present invention, the adjusting screw bar 164 is coupled to the adjusting screw hole 152 of the guide member 150 to allow the twist springs, 180, 180*a* and 180*b* to be adjusted in the degree of elasticity through the screw rotation of the adjusting screw bar 164, thereby finely adjusting the twist springs, 180, 180*a* and 180*b* to the user's desired degree of elasticity, and further, the degree of elasticity of the twist springs 180*a* and 180*b* and the auxiliary elastic member 194 is finely adjusted efficiently to operate in a stable range, so that without any separate buffering device, the degree of elasticity, which may be drastically increased according to angle changes, can be changed just within a given range, thereby allowing the door to be gently open and closed.

Especially, the screws of the adjusting screw bar 164 and the fixing screw bar 165 of the adjustment member 160 are spiral differently from each other in the left-handed and right-handed directions, and after the fine adjustment, if the fixing member 170 is fastened to come into close contact with the guide member 150, the adjusting screw bar 164 and the fixing screw bar 165 of the adjustment member 160 operate reversely to each other with respect to the external force to prevent the twist springs 180*a* and 180*b* from being unwound. Accordingly, the finely adjusted states of the twist springs 180*a* and 180*b* can be rigidly and stably maintained.

Further, the adjustment space 168 is formed between the adjusting screw bar 164 and the fixing screw bar 165 to prevent the occurrence of interference in the adjusting and fixing operations according to the different directions of the screws and at the same time to maintain the set state rigidly.

INDUSTRIAL APPLICABILITY

The hinge for opening/closing the door according to the present invention is capable of providing a user's desired degree of elasticity through fine adjustment, maintaining the set state firmly and stably, and preventing the occurrence of the interference in the adjusting and fixing operations, so that the hinge of the present invention can be usefully applied to various industrial fields.

What is claimed is:

1. A hinge for opening/closing a door, comprising:

a first plate and a second plate coupled correspondingly to the door and a door frame, respectively;

a main housing disposed on the center of one of the first and second plates;

a first auxiliary housing and a second auxiliary housing disposed correspondingly to the upper and lower ends of the first and second plates;

a support member disposed coupledly to interlock the auxiliary housings with the main housing by engaging one of the first and second auxiliary housings;

a guide member having an adjusting screw hole coupled to interlock an opposite one of the first and second auxiliary housings in such a manner as to allow a portion thereof to be inserted into the main housing;

an adjustment member having an adjusting screw bar coupled to the adjusting screw hole of the guide member, wherein a fixing screw bar is formed protruding upwardly from the adjusting screw bar, and wherein each of spiral direction of screws of the adjusting screw bar and the fixing screw bar is formed opposite spiral direction from each other in a left-handed direction and right-handed direction, respectively, and a space is formed between the adjusting screw bar and the fixing screw bar;

a fixing member disposed to contact with the guide member via the space and being fastened to fix the adjustment member thereto; and springs disposed between the support member and the adjustment member to adjust a degree of elasticity according to a rotation of the adjustment member.

2. The hinge for opening/closing a door according to claim 1, wherein the adjustment member has a connector disposed between the adjusting screw bar and the fixing screw bar to form the space and a key groove formed on a top of the fixing screw bar.

* * * * *